US011311068B2

(12) United States Patent
Hilliard, Sr.

(10) Patent No.: US 11,311,068 B2
(45) Date of Patent: Apr. 26, 2022

(54) SONIC WAVE REDUCING HELMET

(71) Applicant: James Bernard Hilliard, Sr., St. Petersburg, FL (US)

(72) Inventor: James Bernard Hilliard, Sr., St. Petersburg, FL (US)

( * ) Notice: Subject to any disclaimer, the term of this patent is extended or adjusted under 35 U.S.C. 154(b) by 155 days.

(21) Appl. No.: 16/947,159

(22) Filed: Jul. 21, 2020

(65) Prior Publication Data

US 2021/0321709 A1 Oct. 21, 2021

Related U.S. Application Data

(60) Provisional application No. 63/010,944, filed on Apr. 16, 2020.

(51) Int. Cl.
*A42B 3/16* (2006.01)
*A42B 3/06* (2006.01)

(52) U.S. Cl.
CPC ..... *A42B 3/163* (2013.01); *A42B 3/063* (2013.01)

(58) Field of Classification Search
CPC ..... A42B 3/163; A42B 3/063
See application file for complete search history.

(56) References Cited

U.S. PATENT DOCUMENTS 4,665,569 A * 5/1987 Santini ..... A42B 3/32 2/425
5,349,893 A * 9/1994 Dunn ..... F41H 5/04 2/2.5
8,844,066 B1 * 9/2014 Whitcomb ..... A42B 3/08 2/413
9,173,445 B1 * 11/2015 Whitcomb ..... A42B 3/069
9,726,249 B2 * 8/2017 Horstemeyer ..... A41D 13/015
9,750,297 B1 * 9/2017 Mini Townson ..... A42B 3/046
10,455,883 B2 * 10/2019 Brown ..... A42B 3/124
2009/0266663 A1 * 10/2009 Lin ..... A42B 3/063 188/372
2011/0212320 A1 * 9/2011 Greenhill ..... B32B 5/30 428/313.3
2011/0277201 A1 * 11/2011 Lam ..... F41H 1/04 2/2.5
2012/0234164 A1 * 9/2012 Kucherov ..... B32B 17/10761 89/36.02
2013/0000475 A1 * 1/2013 Eckhoff ..... F41H 1/02 89/36.02
2013/0273273 A1 * 10/2013 Greenhill ..... B32B 27/14 428/34.1
2014/0007761 A1 * 1/2014 Haidar ..... B60N 2/4415 89/36.02
2014/0073734 A1 * 3/2014 Nauman ..... B29C 43/021 524/571

(Continued)

*Primary Examiner* — Khaled Annis
(74) *Attorney, Agent, or Firm* — Dunlap Bennett & Ludwig, PLLC

(57) ABSTRACT

A helmet defining an opening for a user's head, the helmet including an outer shell providing a wave guide exit operatively associated with an integrated wave guide layer surrounded by the outer shell, the wave guide layer being adapted to direct sonic waves out the wave guide exit, thereby substantially preventing the sonic waves from penetrating through a remainder of the helmet to the opening. The wave guide layer may be a sonic wave transmission medium composed of acoustic metamaterial, wherein the wave guide layer communicates with the wave guide exit.

13 Claims, 3 Drawing Sheets

(56) References Cited

U.S. PATENT DOCUMENTS

| | | | | |
|---|---|---|---|---|
| 2014/0099472 | A1* | 4/2014 | Greenhill | A42B 3/12 428/147 |
| 2014/0196198 | A1* | 7/2014 | Cohen | F41H 1/04 2/414 |
| 2014/0215694 | A1* | 8/2014 | Grice | A42B 3/064 2/411 |
| 2015/0090522 | A1* | 4/2015 | Weissner | A42B 3/163 181/211 |
| 2015/0237929 | A1* | 8/2015 | Greenhill | F41H 5/04 428/328 |
| 2015/0305427 | A1* | 10/2015 | Prabhu | A42B 3/128 2/412 |
| 2016/0113348 | A1* | 4/2016 | Twardowski, Jr. | A42B 3/063 2/412 |
| 2016/0227867 | A1* | 8/2016 | Twardowski | A42B 3/063 |
| 2017/0030686 | A1* | 2/2017 | Rockenfeller | F41H 5/0485 |
| 2018/0049484 | A1* | 2/2018 | Markison | A41D 13/065 |
| 2018/0077989 | A1* | 3/2018 | Horstemeyer | F16F 1/025 |
| 2018/0077991 | A1* | 3/2018 | Horstemeyer | B32B 27/12 |
| 2018/0255861 | A1* | 9/2018 | Ho | A42B 3/14 |
| 2018/0255862 | A1* | 9/2018 | Ho | A42B 3/12 |
| 2019/0110545 | A1* | 4/2019 | Lee | A42B 3/063 |
| 2019/0133235 | A1* | 5/2019 | Domanskis | A42B 3/0473 |
| 2020/0347902 | A1* | 11/2020 | Markison | B32B 25/045 |
| 2021/0321709 | A1* | 10/2021 | Hilliard, Sr. | A42B 3/063 |

* cited by examiner

SONIC WAVE REDUCING HELMET

CROSS-REFERENCE TO RELATED APPLICATION

This application claims the benefit of priority of U.S. provisional application number 63/010,944, filed 16 Apr. 2020, the contents of which are herein incorporated by reference.

BACKGROUND OF THE INVENTION

The present invention relates to helmets and, more particularly, to helmets integrated with acoustic wave guide technology to reduce or eliminate concussions.

Severe concussions may result due to sonic sound waves. Conventional helmets, such as use for the military and athletics, only address forces resulting from physical contact with an object (e.g., by providing bullet proofing and cushioning) and G-Forces as the cause of concussions. These conventional helmets do not address the resulting sonic sound wave that is produced by forceful contact with other objects, surfaces, blast waves, or the like.

Sonic sound or acoustic waves are a type of energy propagation through a medium by means of adiabatic compression and decompression and can cause blast injuries and severe concussions.

As can be seen, there is a need for helmets integrated with acoustic wave guide technology to reduce or eliminate concussions. The present invention embodies wave guides and sound reducing metamaterials adapted to radiate acoustic energy along predefined directions, preventing sonic sound waves from penetrating the brain. By placing acoustic wave guide technology inside the outer shell of helmet, concussions should be reduced or eliminate concussions that result from sonic sound waves penetrating the brain.

SUMMARY OF THE INVENTION

In one aspect of the present invention, a helmet includes the following: an outer shell having a peripheral edge defining a head opening; a wave guide exit dispose adjacent said peripheral edge; and a wave guide layer overlain by the outer shell, the wave guide layer configured to direct sonic waves out the wave guide exit, whereby a sonic wave striking the outer shell are substantially prevented from penetrating through a remainder of the helmet to a head compartment communicating with the head opening.

In another aspect of the present invention, the helmet includes the following: an outer shell having a peripheral edge defining a head opening; a wave guide exit dispose adjacent said peripheral edge; a wave guide layer overlain by the outer shell; the wave guide layer is propagatively coupled to the wave guide exit for directing sonic waves out the wave guide exit; the wave guide layer being a sonic wave transmission medium comprising acoustic metamaterial, wherein the wave guide exit extends between a portion of the wave guide layer and the outer shell, and wherein the helmet is adapted so that the wave guide exit is adjacent to a lateral portion of a neck of a human wearer of the helmet.

In yet another aspect of the present invention, the helmet further includes a secondary barrier layer overlain by the wave guide layer, the secondary barrier layer comprising a plurality of disks spaced apart, wherein sandwiched between each adjacent disks is a membrane; and two layers of fabric sandwiching the plurality of disks.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a helmet defining an opening for a user's head, the helmet including an outer shell providing a wave guide exit operatively associated with an integrated wave guide layer surrounded by the outer shell, the wave guide layer being configured to direct sonic waves out the wave guide exit, thereby substantially preventing the sonic waves from penetrating through a remainder of the helmet to the opening. The wave guide layer may be a sonic wave transmission medium composed of acoustic metamaterial, wherein the wave guide layer communicates with the wave guide exit.

The wave guide technology of the present invention will reduce or eliminate concussions. The present invention uses guides and sound-reducing meta materials to radiate acoustic energy along predefined directions, preventing sonic sound waves from penetrating the brain. By placing acoustic wave guide technology and sound-reducing meta materials inside the outer shell of military and athletic helmets, this will reduce or eliminate concussions that result from sonic sound waves penetrating the brain.

Figure 1:
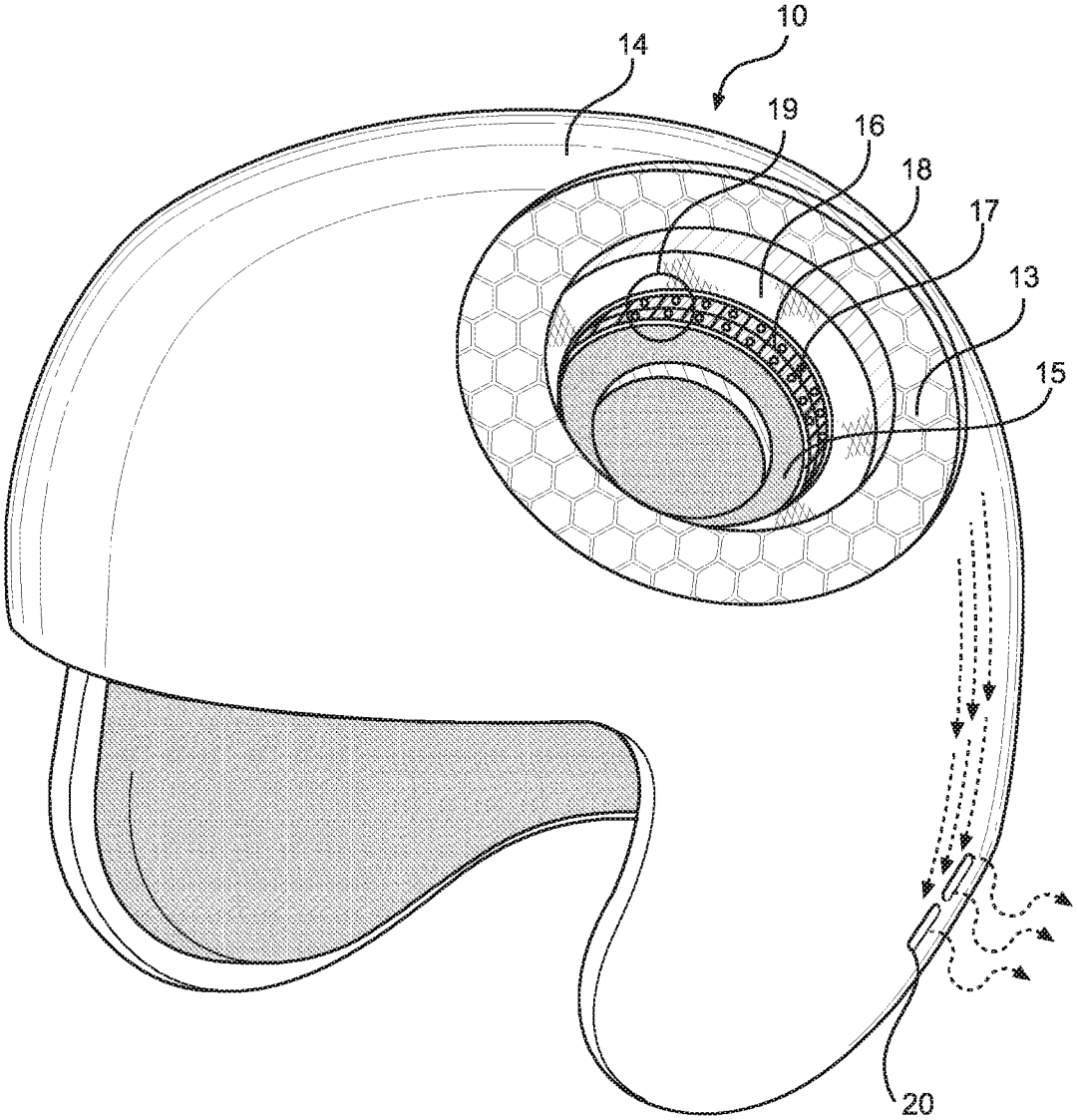
FIG. 1 is a perspective view of an exemplary embodiment of the present invention, with a portion cut away from the helmet for clarity.
Figure 2:
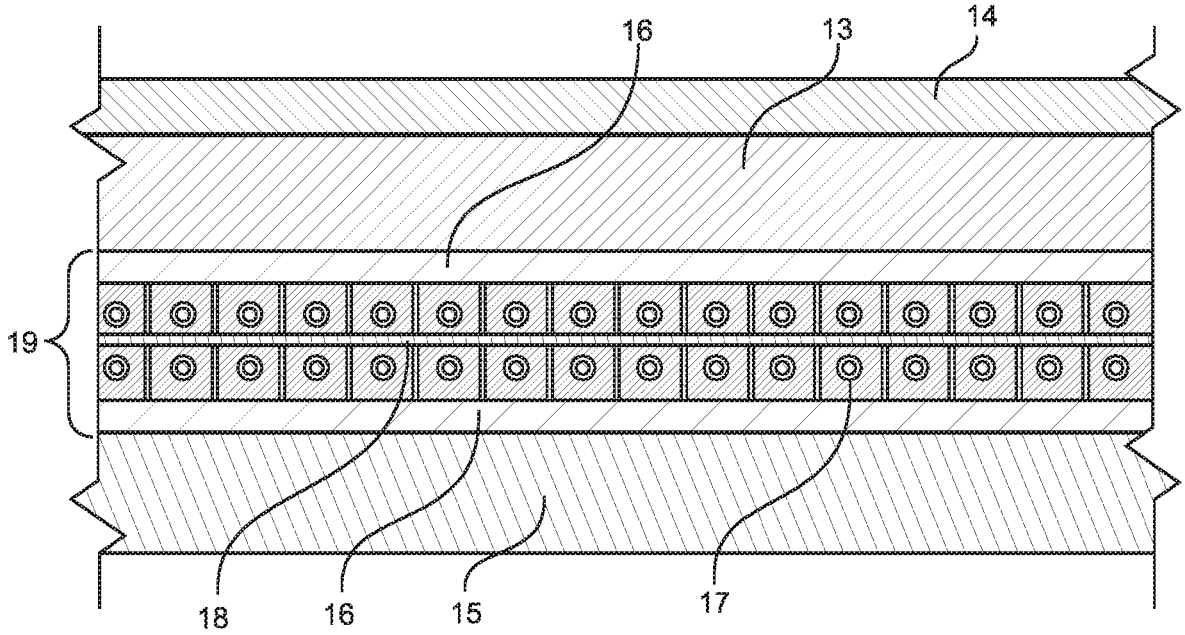
FIG. 2 is a cross-section view of an exemplary embodiment of the present invention.
Figure 3:
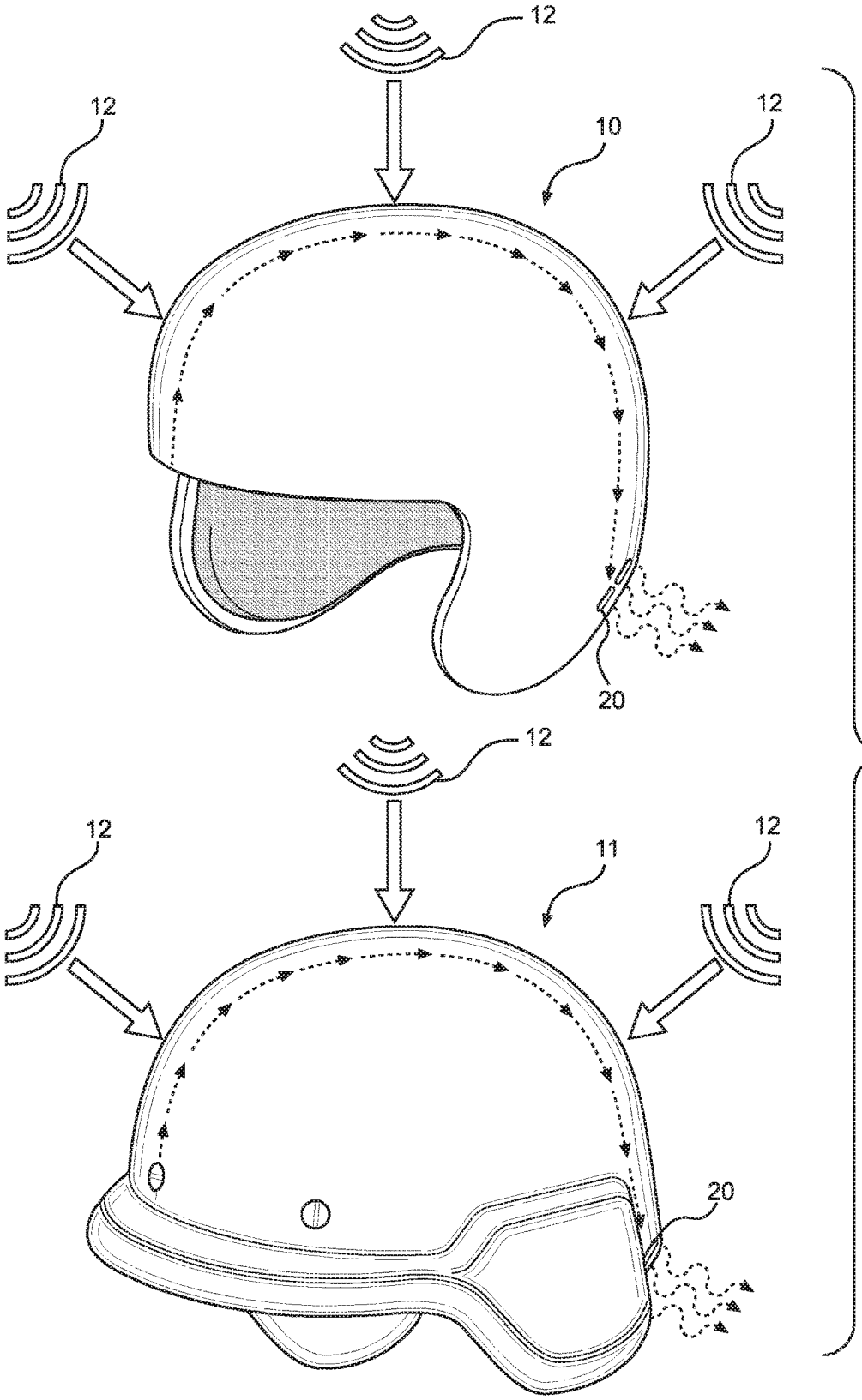
FIG. 3 are two perspective views of an exemplary embodiment of the present invention, shown in use.

Referring now to FIGS. 1-3, embodiments of the present invention may include the following components:

10: is a football helmet
11: is a military helmet
12: is a sonic wave
13: is a wave guide layer
14: is an outer shell of the helmet
15: is foam
16: is fabric
17: is a hard disk
18: is a hard-plastic membrane
19: is a secondary sound barrier of 16,17,18
20: is a sonic wave exit In an exemplary embodiment, a football helmet 10 has an outer shell 14. Within the outer shell 14 is a wave guide layer 13. The wave guide layer 13 directs sonic waves 12 away from a wearer's brain and out a sonic wave exit 20 (see FIG. 3). The wave guide layer 13 may be a sonic wave transmission medium that is propagatively coupled to the wave guide exit 20. In other words, the wave guide layer 13 enables sonic waves to propagate therethrough (as a transmission medium) and the wave guide layer 13 terminates (in part) at the wave guide exit 20 so that sonic and/or acoustic waves 12 coming in contact with the wave guide layer 13 propagate through the wave guide layer 13 (easier than the surrounding layers due to the relative properties of bulk modulus β, density p, and chirality and the like) to the wave guide exit 20—i.e., "propagatively coupled" is expressly intended to impart this novel meaning.

A secondary sound barrier 19 may include a fabric 16, a hard disk 17, and a hard-plastic membrane 18. The fabric layer 16 may be formed with a material like Kevlar to help reduce any remaining sonic sound waves that are not redirected by the wave guide layer 13. Within the fabric layer 16 is a hard disk 17. Within the hard disk 17 is a hard-plastic membrane 18. These elements, in combination with one another, further aid in the prevention of sonic waves 12 from reaching a wearer's brain by reducing the magnitude of the remaining waves. Finally, in instances where additional cushioning is needed, foam 15 may be provided, such as with use as an athletic helmet 10. In instances where foam 15 is used, the foam 15 may be graphene infused. When the helmet is embodied as a military helmet 11, the foam 15 may be omitted if not needed.

In use, a sonic wave 12 that is directed towards a wearer's head is substantially re-directed by the wave guide layer 13 out the sonic wave exit 20. The secondary sound barrier 19 dissipates remaining waves that were not re-directed away form a wearer's head, helping to stop concussions from occurring.

Embodiments of the present invention may be worn in the same manner as current ballistic and athletic head gear is currently worn. Furthermore, this technology can be used in any environment where concussions and safety are concerns.

The wave guide layer 13 may be composed of an acoustic metamaterial, such as sonic crystal, or phononic crystal, and designed and adapted to control and direct through manipulating parameters such as the bulk modulus β, density ρ, and chirality.

It should be understood, of course, that the foregoing relates to exemplary embodiments of the invention and that modifications may be made without departing from the spirit and scope of the invention as set forth in the following claims.

What is claimed is:

1. A helmet, comprising:

an outer shell having a peripheral edge defining a head opening;

a wave guide exit dispose adjacent said peripheral edge; and a wave guide layer overlain by the outer shell, the wave guide layer configured to direct sonic waves out the wave guide exit, whereby a sonic wave striking the outer shell are substantially prevented from penetrating through a remainder of the helmet to a head compartment communicating with the head opening.

2. The helmet of claim 1, wherein the wave guide layer is operatively associated with the wave guide exit.

3. The helmet of claim 1, wherein the wave guide layer is a sonic wave transmission medium that is propagatively coupled to the wave guide exit.

4. The helmet of claim 1, wherein the wave guide layer is an acoustic metamaterial.

5. The helmet of claim 4, wherein the acoustic metamaterial comprises sonic crystal.

6. The helmet of claim 4, wherein the acoustic metamaterial comprises phononic crystal.

7. The helmet of claim 1, wherein the wave guide exit extends between a portion of the wave guide layer and the outer shell.

8. The helmet of claim 1, wherein the helmet is adapted so that the wave guide exit is adjacent to a lateral portion of a neck of a human wearer of the helmet.

9. The helmet of claim 1, further comprising a secondary barrier layer overlain by the wave guide layer, the secondary barrier layer comprising: a plurality of disks spaced apart, wherein sandwiched between each adjacent disks is a membrane.

10. The helmet of claim 9, the secondary barrier layer further comprising two layers of fabric sandwiching the plurality of disks.

11. A helmet, comprising:

an outer shell having a peripheral edge defining a head opening;

a wave guide exit dispose adjacent said peripheral edge;

a wave guide layer overlain by the outer shell;

the wave guide layer is propagatively coupled to the wave guide exit for directing sonic waves out the wave guide exit;

the wave guide layer being a sonic wave transmission medium comprising acoustic metamaterial, wherein the wave guide exit extends between a portion of the wave guide layer and the outer shell, and wherein the helmet is adapted so that the wave guide exit is adjacent to a lateral portion of a neck of a human wearer of the helmet.

12. The helmet of claim 11, further comprising a secondary barrier layer overlain by the wave guide layer, the secondary barrier layer comprising a plurality of disks spaced apart, wherein sandwiched between each adjacent disks is a membrane.

13. The helmet of claim 12, the secondary barrier layer further comprising two layers of fabric sandwiching the plurality of disks.

* * * * *